US006972520B2

(12) United States Patent
Davey, Jr.

(10) Patent No.: US 6,972,520 B2
(45) Date of Patent: Dec. 6, 2005

(54) METHOD OF REMOVING CONTAMINANTS FROM A DOUBLE-ENDED ARC DISCHARGE TUBE

(75) Inventor: Ernest A. Davey, Jr., Hampton Falls, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/672,159

(22) Filed: Sep. 26, 2003

(65) Prior Publication Data

US 2004/0056601 A1 Mar. 25, 2004

Related U.S. Application Data

(62) Division of application No. 09/963,762, filed on Sep. 26, 2001, now Pat. No. 6,669,521.

(51) Int. Cl.[7] ..... H01J 17/18
(52) U.S. Cl. ..... 313/623; 313/634
(58) Field of Search ..... 313/623–634

(56) References Cited

U.S. PATENT DOCUMENTS

| | | | | |
|---|---|---|---|---|
| 3,685,880 A | | 8/1972 | Sobieski | 445/26 |
| 4,310,774 A | | 1/1982 | Karlotski et al. | 313/228 |
| 4,540,373 A | | 9/1985 | Rothwell et al. | 445/22 |
| 4,959,587 A | * | 9/1990 | Schug | 313/623 |
| 5,037,342 A | | 8/1991 | Barthelmes et al. | 445/22 |
| 5,087,218 A | | 2/1992 | Ahlgren et al. | 445/27 |
| 5,138,227 A | | 8/1992 | Heider et al. | 313/623 |
| 5,176,558 A | | 1/1993 | Newell | 445/26 |
| 5,213,536 A | | 5/1993 | Hough et al. | 445/27 |
| 5,343,117 A | * | 8/1994 | Wyner et al. | 313/623 |
| 5,468,168 A | | 11/1995 | Balaschak et al. | 445/26 |
| 5,825,129 A | | 10/1998 | Van der Leeuw et al. | 313/634 |
| 5,877,591 A | | 3/1999 | Nagata et al. | 313/634 |
| 5,936,349 A | | 8/1999 | Fukai et al. | 313/623 |
| 5,984,749 A | | 11/1999 | Nishibori et al. | 445/26 |
| 5,986,403 A | | 11/1999 | Jansen et al. | 313/623 |
| 6,004,503 A | | 12/1999 | Neil | 264/632 |
| 6,135,840 A | | 10/2000 | Kanzaki | 445/26 |
| 6,354,901 B1 | | 3/2002 | Bundo et al. | 445/26 |
| 6,368,175 B1 | | 4/2002 | Horiuchi et al. | 445/26 |
| 6,547,619 B1 | | 4/2003 | Ohkawai et al. | 445/26 |
| 6,612,892 B1 | | 9/2003 | Lamouri et al. | 445/26 |

* cited by examiner

*Primary Examiner*—Joseph Williams
(74) *Attorney, Agent, or Firm*—Robert F. Clark

(57) ABSTRACT

A method of removing contaminants from a double-ended arc discharge tube includes the steps of providing at least one capillary channel at each end of the tube, where the ends of the tube are sealed closed except at the capillary channels, and introducing a flushing gas into the tube through one capillary channel at one end of the tube and removing the flushing gas and contaminants through another capillary channel at another end of the tube. During manufacture, the double-ended arc discharge tube has a sealed electrode and an open capillary channel at each end of the tube.

2 Claims, 2 Drawing Sheets

METHOD OF REMOVING CONTAMINANTS FROM A DOUBLE-ENDED ARC DISCHARGE TUBE

CROSS REFERENCES TO RELATED APPLICATIONS

This application is a division of application Ser. No. 09/963,762, filed Sep. 26, 2001, now U.S. Pat. No. 6,669,521, issued Dec. 20, 2003.

BACKGROUND OF THE INVENTION

The present invention is directed to a method of removing contaminants from a double-ended arc discharge tube and to a configuration of the arc discharge tube during manufacture.

With reference to FIG. 1, a conventional arc lamp 10 includes a double-ended arc discharge tube 12 with electrodes 14 and 16 sealed in opposite ends of tube 12. Foils 18 and 20 in press seal regions 22 and 24 electrically connect electrodes 14 and 16 to external leads 26 and 28. Tubulation 30 is attached to an opening in a side of tube 12 that leads to discharge region 32. The interior surface of discharge region 32 and electrodes 14 and 16 contain contaminants that should be removed to improve lamp performance. The contaminants are removed with a flushing gas that is fed into discharge region 32 and then removed, carrying away the contaminants. Tubulation 30 includes an inner needle 34 through which a flushing gas is introduced into region 32 and an annular portion around needle 34 through which the flushing gas and contaminants are removed. This lamp is disclosed in U.S. Pat. No. 5,176,558 that is incorporated by reference.

As is apparent from FIG. 1, the inlets and outlets for the flushing gas are very close to each other at one side of tube 12. This is necessary because tubulation 30 is desirably small to avoid a large hole in the side of tube 12 that must be closed later. The closure of such a hole is accomplished with a tip-off that can undesirably distort the side of tube 12 and is a cold spot during lamp operation that degrades lamp color and uniformity of emitted light.

However, the small tubulation hole forces the inlet and outlet for the flushing gas close to each on one side of tube 12, and the cleaning action of the flushing gas is reduced. Some areas of the interior of tube 12 receive less flow and contaminants may remain in such areas. Further, flushing gas may be wasted because the close proximity of the inlet and outlet may allow clean flushing gas to be immediately drawn through the outlet before it has been flushed through the interior of tube 12. A more robust and economical cleaning action, preferably without the tip-off, is desirable.

One technique for introducing a flushing gas without a tip-off is disclosed in U.S. Pat. No. 5,037,342 that is also incorporated by reference. This patent relates to a single-ended arc discharge tube that includes a removable pipe in the sealed end through which gases and materials are introduced into the arc discharge region. Flushing gas can be provided through the removable pipe and thus the tube does not require a tip-off.

However, the flushing gas is introduced and removed from the same orifice and thus the removable tube affords the same, less rigorous, cleaning action noted above because the flushing gas does not flow generally uniformly throughout the interior of the tube. Further, the insertion and removal of the pipe adds steps and complexity to the process.

In a further embodiment of this patent in which the arc discharge tube is placed in an outer envelope that includes only a gas fill, two capillaries are provided in the sealed end of the outer envelope. However, the two capillaries are close to each other in one end of the outer envelope and cannot be used for thorough cleaning. Indeed, the patent recognizes this shortcoming and states that the two capillaries are useful where only a fill gas is to be introduced and the need for high purity is less important.

SUMMARY OF THE INVENTION

An object of the present invention is to provide a novel method for flushing contaminants from a double-ended arc discharge tube that offers rigorous and economical cleaning action without forming a tip-off on the arc discharge tube.

A further object of the present invention is to provide a novel method of removing contaminants from a double-ended arc discharge tube that includes the steps of providing at least one capillary channel at each end of the tube, where the ends of the tube are sealed closed except at the capillary channels, and introducing a flushing gas into the tube through at least one capillary channel at one end of the tube and removing the flushing gas and contaminants through one or more capillary channels at another end of the tube.

A yet further object of the present invention is to provide a double-ended arc discharge tube that, during manufacture, has a sealed electrode and one or more capillary channels at each end of the arc discharge tube.

Another object of the present invention is to provide a novel method of making a double-ended arc discharge tube, that includes the steps of providing a cylinder of light transmissive material, inserting electrodes into each end of the cylinder, pressing the light transmissive material to seal the electrodes and form an unfilled double-ended arc discharge tube while at each of the pressed ends leaving open at least one capillary channel, removing contaminants from the tube by flushing a gas lengthwise through the tube using the capillary channels at both ends of the tube, introducing a fill gas and lamp chemicals into the tube using at least one of the capillary channels, and closing the capillary channels.

DESCRIPTION OF PREFERRED EMBODIMENTS

With reference now to FIGS. 2–5, the method of the present invention improves the flow of flushing gas through a double-ended arc discharge tube by providing capillary channels at both ends of the tube. Flushing gas is introduced through the capillary channel at one end of the tube and the flushing gas and contaminants are removed through the capillary channel at the other end of the tube. The straight flow of gas through the entire tube improves the cleaning action of the flushing gas without wasting the gas, and without the undesirable tip-off.

Figure 1:
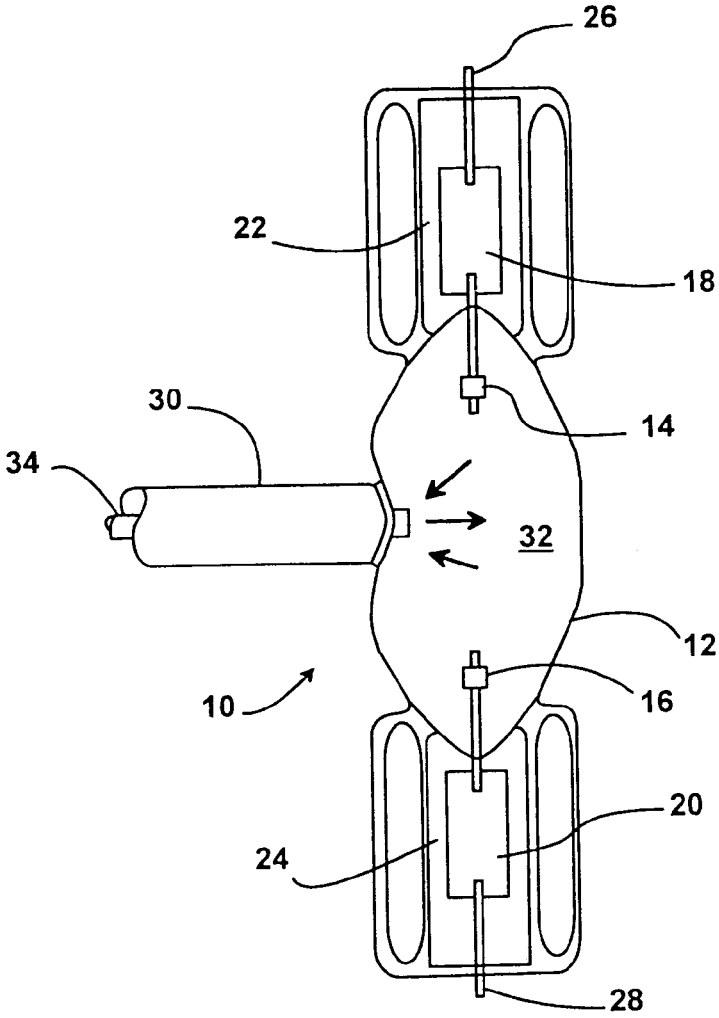
Fig. 1 (Prior Art)
FIG. 1 is a pictorial representation of a double-ended arc discharge tube of the prior art illustrating a known method of flushing the tube with a tubulation.
Figure 4:
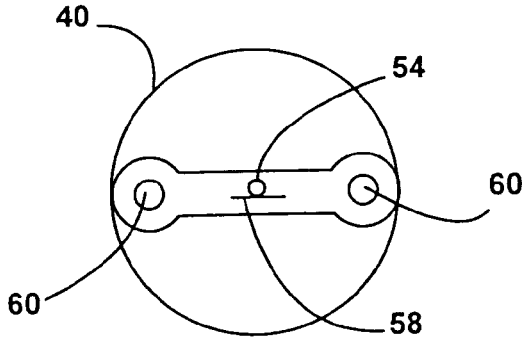
FIG. 4 is a cross sectional view of the embodiment of FIG. 2, taken through line IV—IV, showing open capillary channels.
Figure 2:
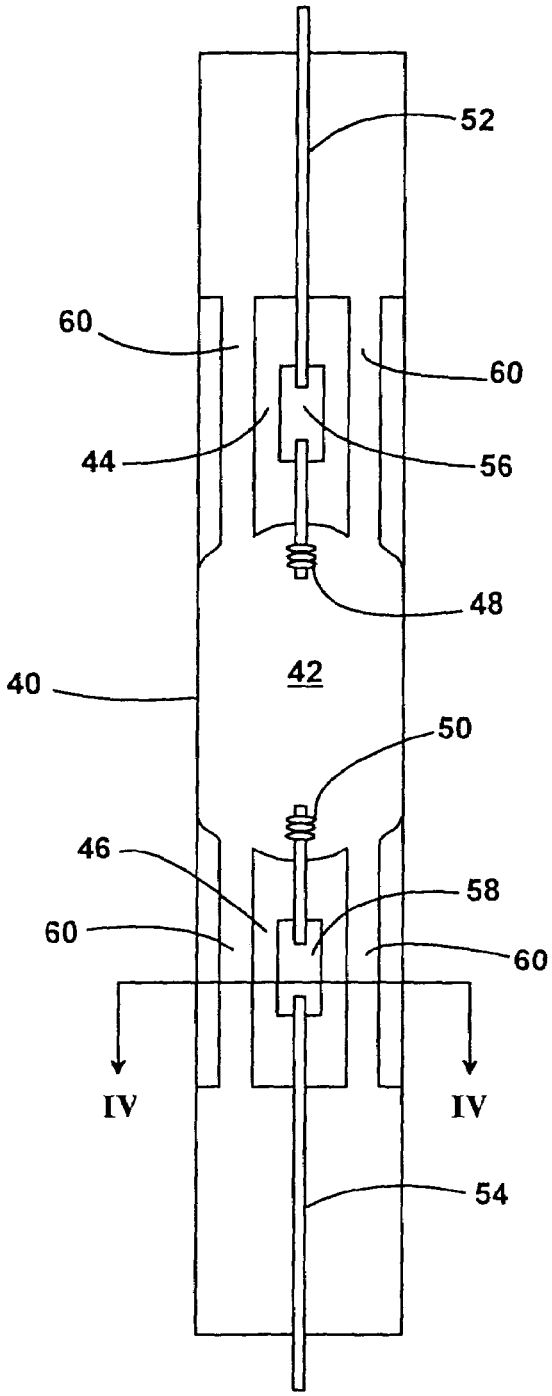
FIG. 2 is a plan view of a double-ended arc discharge tube incorporating the novel method disclosed herein.
Figure 3:
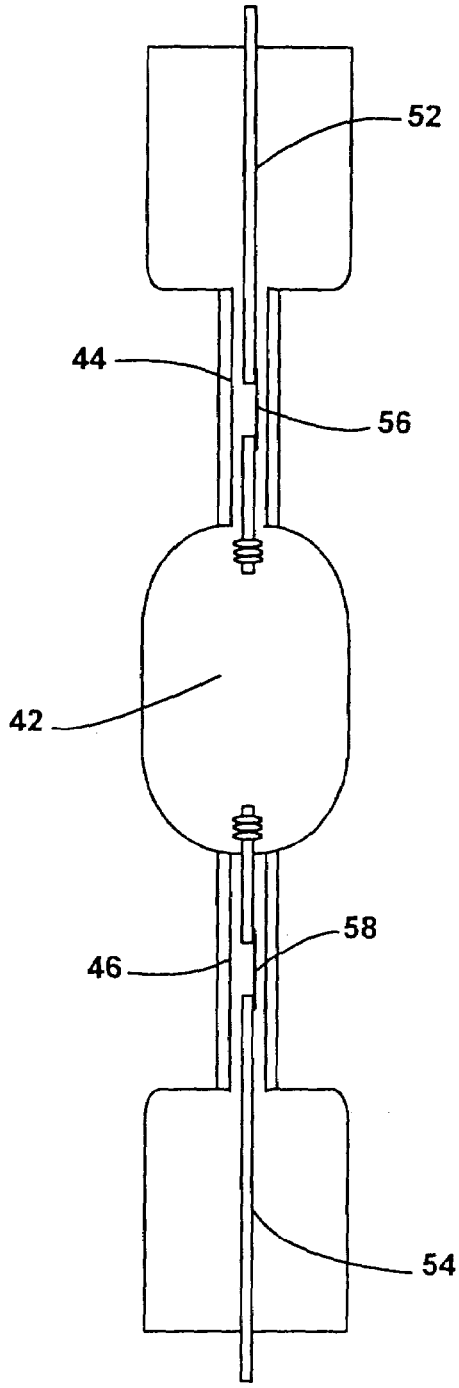
FIG. 3 is a side view of the embodiment of FIG. 2.

As shown in FIGS. 2–4, during manufacture of an arc discharge tube, tube 40 includes an arc discharge region 42 between press seal regions 44 and 46. Electrodes 48 and 50 extend into discharge region 42 from respective press seal regions 44 and 46 and are electrically connected to respective external leads 52 and 54 with foils 56 and 58. Each press seal region 44 and 46 is sealed closed with the foil as is conventional in such tubes, except that at least one capillary channel 60 extends from outside tube 40 through the respective press seal region 44 and 46 into discharge region 42. Capillary channels 60 are a passageway for a gas or solid material that is to be placed inside discharge region 42. While one capillary channel 60 at each end will provide satisfactory results, better results are achieved with at least two capillary channels 60 spaced apart on either side of the foil, such as shown in FIG. 2. More channels 60 can be provided to further improve the uniformity of the flushing gas flow through discharge region 42, but congestion in the seal region suggests that two channels should be sufficient.

A flushing gas is introduced into discharge region 42 through capillary channels 60 at one end of tube 40 and removed from discharge region 42 through capillary channels 60 at the other end of tube 40. The flow can be continuous in one direction or may alternate directions. In either event, the flow is more uniform than provided by one or more openings in one side or at one end of the discharge region. The flushing gas removes contaminants from the interior of discharge region 42 and from electrodes 48 and 50.

The method of making a double-ended arc discharge tube includes the steps of providing a tube of light transmissive material cut from a longer cylinder of such material, such as quartz. Electrode structures, which may be conventional, are inserted into each end of the cylinder. This may be accomplished one end at a time by sliding the tube over an electrode structure held upright on a holder. The electrode structures may include the electrode that is in the discharge region, the foil portion that is typically molybdenum, and the exterior lead. The tube may be heated at the end into which the electrode structure is inserted and the heated tube pressed onto the foil portions of the electrodes at respective ends of the cylinder to seal the electrodes into the pressed material and form an unfilled double-ended arc discharge tube.

The pressing may be accomplished with press feet that have a recess that forms the capillary channel. As indicated by the pattern for the press seal region shown in FIG. 4, the press feet may have round mold recesses at the ends that are the inverse of the press seal region pattern shown. The capillary channels need not be round, although round channels are more easily formed.

For example, a press seal machine may be employed to hermetically seal the electrical leads to a quartz tube. The electrical lead may be positioned on a mount holder on the press seal apparatus with the electrode upright. The quartz tube may be lowered onto the lead and mechanically held in place. Gas burners may be placed in close proximity to the quartz tube and the burners may be rotated around the tube. When the quartz temperature reaches approximately 2100° C., burner rotation may be stopped. The mechanical press feet are then deployed for use. The opposing press mechanisms travel towards one another to pinch the hot plastic quartz and capture the lead. The foils provide the hermetic seal and the electrodes that are typically tungsten protrude into the discharge region. The process is repeated at the other end of the tube. With proper press feet design, the capillary channels will remain adjacent to the leads.

Thereafter, contaminants are removed from the tube by flushing a gas lengthwise through the tube using the capillary channels at both ends of the tube. The flushing gas may be a conventional flushing gas, such as an inert gas.

A fill gas and any solid lamp chemicals that are to be introduced into the discharge region (mercury, conventional metal halide salts, etc.) may be introduced into the tube using at least one of the capillary channels. The fill gas may be the same as the flushing gas, if appropriate. The flushing gas and the fill gas may be pumped into the capillary channels from a source of gas or may be drawn into the capillary channels at one end of the tube by applying a vacuum at the capillary channels at the other end of the tube. To this end, a vacuum pump may be provided.

Figure 5:
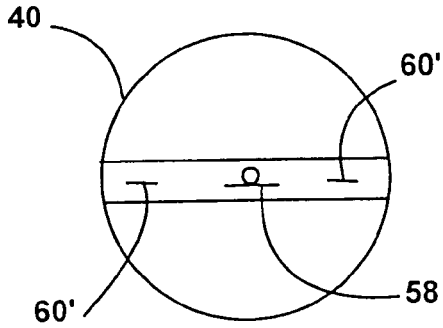
FIG. 5 is a cross sectional view of the embodiment of FIG. 2 showing closed capillary channels.

As shown in FIG. 5, the capillary channels are then closed by heating the glass to form closed channels 60' that seal the fill gas and the other material inside the discharge region.

While embodiments of the present invention have been described in the foregoing specification and drawings, it is to be understood that the present invention is defined by the following claims when read in light of the specification and drawings.

I claim:

1. A double-ended arc discharge tube having press seal regions at each end and a discharge region between the press seal regions;

the press seal regions each having an electrode structure sealed thereto, each electrode structure comprising an electrode extending into the discharge region, a foil hermetically sealed to the discharge tube, and an external lead;

each press seal region further having an open capillary channel that extends from outside the discharge tube through the press seal region and into the discharge region in order to provide a passageway for a gas or solid material that is to be placed inside the discharge region.

2. The tube of claim 1, wherein each press seal region of the arc discharge tube has two of said capillary channels.

* * * * *